US005664500A

United States Patent [19]

Lindner et al.

[11] Patent Number: 5,664,500

[45] Date of Patent: Sep. 9, 1997

[54] SHIFTING DEVICE FOR HORIZONTAL SHIFTING OF HEAVY LOADS

[75] Inventors: Dietmar Lindner, Eckersdorf; Dieter Hesse, Erlangen, both of Germany

[73] Assignee: Lukas Hydraulik GmbH, Erlangen, Germany

[21] Appl. No.: 521,630

[22] Filed: Aug. 31, 1995

[30] Foreign Application Priority Data

Feb. 21, 1995 [DE] Germany ..... 295 02 801.7

[51] Int. Cl.[6] ..... B61K 5/00

[52] U.S. Cl. ..... 104/273

[58] Field of Search ..... 104/262, 272, 104/273; 254/33, 45

[56] References Cited

U.S. PATENT DOCUMENTS

| | | | |
|---|---|---|---|
| 2,980,035 | 4/1961 | Cole et al. | 104/273 |
| 4,090,453 | 5/1978 | Ali et al. | 104/273 |
| 4,809,615 | 3/1989 | Brickett | 104/273 |

FOREIGN PATENT DOCUMENTS

| | | | |
|---|---|---|---|
| 766517 | 9/1967 | Canada | 104/273 |

*Primary Examiner*—S. Joseph Morano

*Attorney, Agent, or Firm*—Robin, Blecker, Daley & Driscoll

[57] ABSTRACT

A shifting device for horizontal shifting of heavy loads with at least one lifting cylinder to raise the load, a support, and a preferably hydraulically actuated shifting mechanism, wherein the shifting mechanism has at least one horizontally arranged shifting cylinder which by way of a locking tie-rod is mechanically lockable to the support in different positions on the latter's surface, and which engages in the range of the lifting cylinder or its support and effects a horizontal shifting of it relative to the support characterized in that in the tie-rod casing, the locking tie-rod can be brought vertically from a rest position to a locking position and vice versa, that the locking in the locking position is effective in both directions to the support and that the shifting cylinder can be acted on by force in both directions.

17 Claims, 3 Drawing Sheets

SHIFTING DEVICE FOR HORIZONTAL SHIFTING OF HEAVY LOADS

FIELD OF THE INVENTION

The invention relates generally to a shifting device and pertains more particularly to a shifting device for horizontal shifting of heavy loads, e.g., derailed rail cars or the like.

BACKGROUND OF THE INVENTION

In shifting devices of this type that have become known thus far, a locking tie-rod supports a shifting device against a support contrary to a shifting direction. Once a shifting cylinder has attained its maximum shifting path, however, the shifting cylinder including the tie-rod casing is pulled along, with the locking tie-rod being thereby automatically unlocked with the locking position being effected in the next following recesses in this direction. These known shifting devices were thus provided only for shifting heavy loads in one direction. If, however, a movement in the opposite direction had to be effected with shifting devices of this kind, it was necessary to apply an additional device to the load, and it was based on this per force that it was necessary for operators to have to go under the load.

SUMMARY OF THE INVENTION

The present invention has as its primary object the provision of improving a shifting device in such a manner that an exact and secure Shift can be effected in both directions to the support.

In attaining this object, the invention provides that in a tie-rod casing, a locking tie-rod can be brought vertically from a rest position to a locking position and vice versa, that the locking in the locking position is effective in both directions towards the support and that a shifting cylinder can be acted on by force in both directions. This invention ensures operation in both directions without operating personnel having to go below the load in order to see to reversing of the shifting device.

The foregoing and other objects and features of the invention will be further understood from the following detailed description of preferred embodiments thereof and from the drawings, wherein like reference numerals identify like parts throughout.

DETAILED DESCRIPTION OF PREFERRED EMBODIMENTS AND PRACTICES

Figure 1:
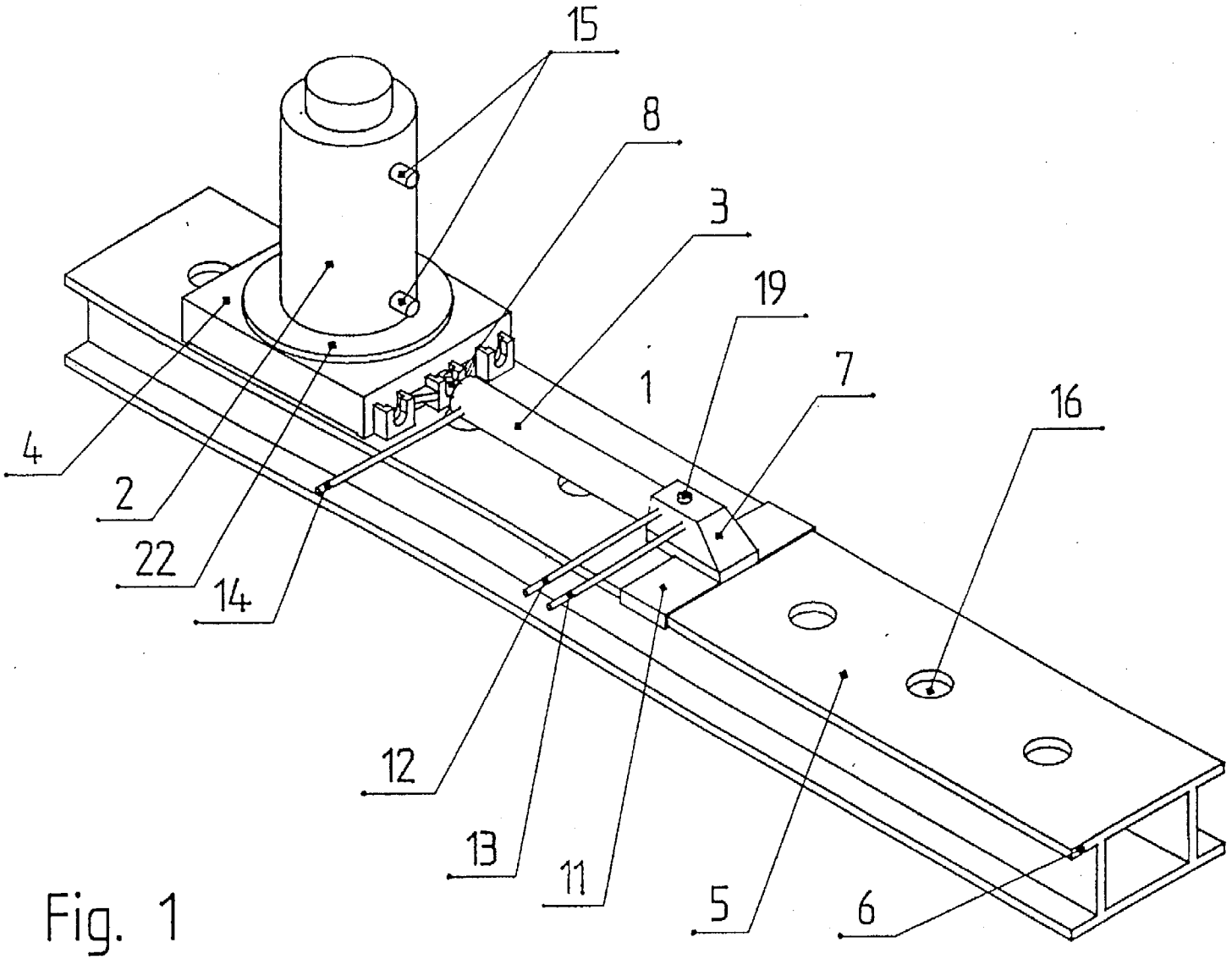
FIG. 1 is a perspective view of a shifting device situated on a rerailing bridge in accordance with the principles of the present invention.

FIG. 1 shows a shifting device 1 of the present invention. As shown in FIG. 1, the shifting device 1 is situated on the upper side of a support 5, for example a rerailing bridge placed on the upper side of the rails, which is shown only in part.

The shifting device 1 includes a lifting cylinder 2 for raising the load to be shifted. The lifting cylinder 2 is connected with two hydraulic pressure lines by means of two connections 15. Between the support 5 and the lifting cylinder 2 there is a base 4 at the bottom side of which inserts (not shown) are advantageously provided to increase the gliding ability of base 4 along support 5.

Arranged between the lifting cylinder 2 and its base 4 is a so-called slide plate 22, which by way of a holding boss 6 is connected on its bottom side (not shown) to the base 4 for the lifting cylinder 2. The holding boss 6 engages a corresponding recess 16 in the base 4 in this manner (not shown) and it is dimensioned so that a lateral movement of the slide plate 22 is made possible, particularly in the cross direction to the moving direction of the base 4.

The horizontal shifting of the lifting cylinder 2 including its base 4 is effected by way of a shifting cylinder 3 extending horizontally along the support 5, one end of which exhibits a tie-rod casing 7 and the other end of which engages the base 4 of lifting cylinder 2 by way of a piston rod 8.

It can furthermore be gathered from FIG. 1 that arranged at determined distances from each other, recesses 16 are provided along the support 5, into which engages a tie-rod, not visible in FIG. 1, which is accommodated in the tie-rod casing 7, to lock the shifting cylinder 3 in both directions to the support 5.

The tie-rod casing 7 displays additionally guide plates 11 which are shaped in such a manner that they embrace bosses arranged laterally at the support 5 and in this way ensure an exact positioning of the tie-rod casing 7, i.e., the tie-rod in cross direction to support 5, without however detrimentally affecting the possibility of longitudinal movement.

The individual connections 12, 13 and 14 of the shifting cylinder 3 or of the tie-rod casing 7, respectively, as well as the connections 15 of the double-acting lifting cylinder 2 are connected by way of suitable connections to a control panel (not shown), so that the operation of the shifting device can be effected at a safe distance from the load.

Figure 2:
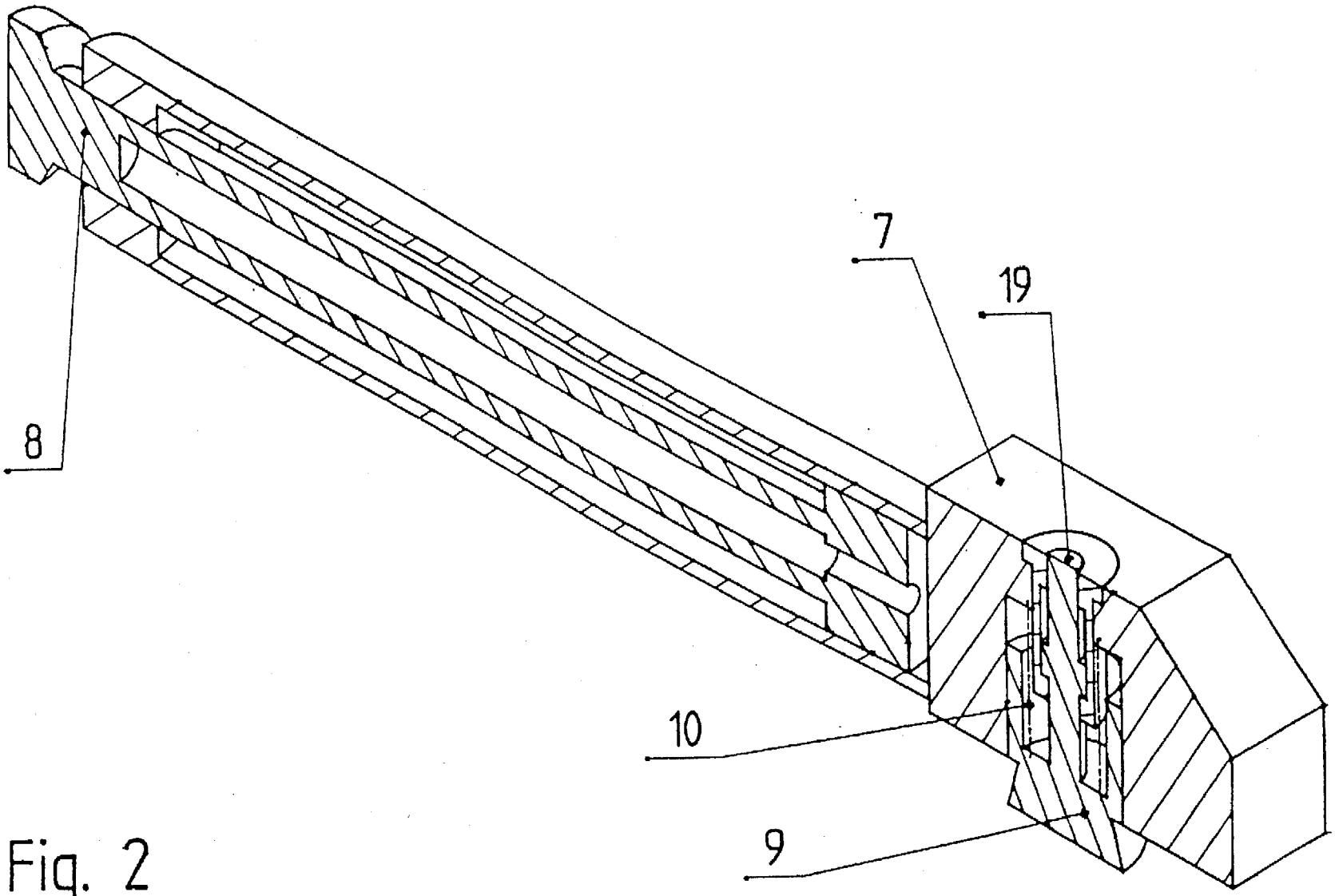
FIG. 2 is a cross-sectional view of a shifting cylinder including a tie-rod and a tie-rod casing of the shifting device according to FIG. 1.

As shown in FIGS. 1 and 2, the tie-rod casing 7 is shaped in such a manner that the tie-rod 9, with the firmly connected tie-rod head 19, is visible at the upper-side of the tie-rod casing 7. In addition, the locking tie-rod 9 is initially tensioned in FIG. 2 by a spring 10 in the locking position, wherein according to FIG. 2, the top side of tie-rod head 19 ends flush with the upper side of the tie-rod casing 7. The movement of the locking tie-rod from the locking position, i.e., the initially tensioned position, to the unlocking position is effected hydraulically, whereby, in the unlocked position of the locking tie-rod, the tie-rod head 19 simultaneously protrudes from the upper side of the locking casing 7 and makes possible an optical control of the condition of the shifting device 1.

Figure 3:
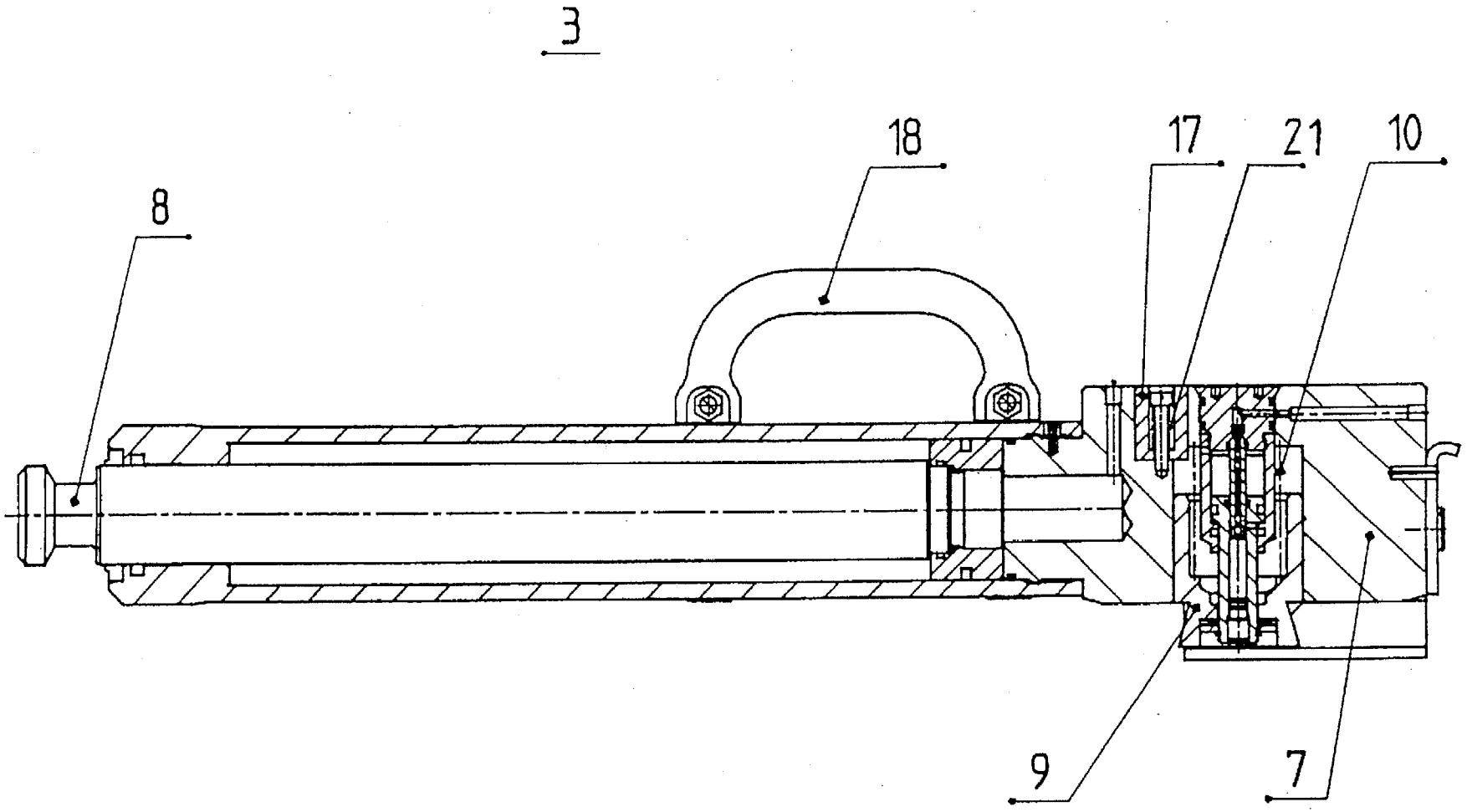
FIG. 3 is a partial cross-sectional view of a modified embodiment of the shifting cylinder including the tie-rod and tie-rod casing.

FIG. 3 shows a slightly modified version of the shifting cylinder 3, including the tie-rod casing 7 and the locking tie-rod 9. The difference with respect to the preceding version is that herein a separate control pin 17 is provided, which in the unloaded state is held in the boring by a spring 21. However, when the locking tie-rod 9 moves over to an unlocking position, the control pin 17 is pushed out of its boring by the movement of locking tie-rod 9 and therefore represents an optical control element to check the respective operating status of the shifting device 1.

In addition, as shown in FIG. 3, the side of locking tie-rod 9 facing the respective recess 16 is shaped tapering upward, which in the case of a horizontal load of the locking tie-rod 9 ensures a self-locking function in the locking condition. It is clear from FIGS. 2 and 3 that the form of the locking tie-rod 9 is intended to ensure a locking function which acts in both directions.

At the upper side of the shifting cylinder 3, a handle 18 is arranged by which the shifting device 1 can be transported or set up in a simple manner.

A connection of the piston rod 8 to the base 4 of lifting cylinder 2 is provided at the left side of the piston rod 8 of the shifting cylinder 3.

Operation of the shifting device 1 according to the invention takes place in such a way that the shifting device 1 is set up at the upper side of the support or rerailing bridge 5. The load is subsequently raised. To shift the load, the shifting cylinder 3 is actuated, whereby the latter is braced by the locking tie-rod 9, which is in the locking position, i.e., it is engaged in one of the recesses 16 provided at the upper side of the support 5 and effects a shifting of the load along the support 5. If the shifting path of the shifting cylinder 3 is exhausted, the locking tie-rod 9 is raised hydraulically inside the locking casing 7, whereby the shifting cylinder 3 can be shifted further or in another direction.

By way of summary, the invention will be seen to provide that in a tie-rod casing, a locking tie-rod can be brought vertically from a rest position to a locking position and vice versa, that the locking in the locking position is effective in both directions towards the support and that a shifting cylinder can be acted on by force in both directions. This invention ensures operation in-both directions without operating personnel having to go below the load in order to see to reversing of the shifting device.

In addition, the locking tie-rod is constantly tensioned by an elastic element, particularly a spring. Retraction of the locking tie-rod is advantageously effected hydraulically.

The tie-rod casing also has guide plates 11 which engage the support and hold the locking tie-rod in a predetermined position at right angles to the longitudinal axis of the support. This ensures an exact positioning of the tie-rod casing in the opposite direction to the support, whereby it is ensured that the locking tie-rod dips into the respective recess without malfunctions occurring.

The recesses are advantageously dimensioned in such a way that by virtue of its own height or its initial tension, the locking tie-rod will move into the recess without problems during the shifting along the support.

The visual controlling device indicates the respective operating status, i.e., a locking or unlocking position, of the locking tie-rod. The tie-rod casing is fashioned in such a manner that in the unlocking state the tie-rod head protrudes from the upper side of the tie-rod casing. A spring-loaded control pin is provided at the upper side of the tie-rod casing, which protrudes from the upper side of the tie-rod casing counter to the spring tension when the locking tie-rod is unlocked. The locking tie-rod has an upward tapering shape at least over a part of its peripheral area in the range of its side that is dipping into a respective recess. The upwardly tapered form of the end of the locking tie-rod dipping into the respective recess ensures a self-locking effect of the shifting device. These are advantageous developments of the shifting device using an optical control as to whether the shifting device is situated completely in the unlocking or locking position.

The use of a double-acting shifting cylinder, e.g., a telescopic shifting cylinder, offers increased shifting capacities. The use of a control platform which by way of control lines is connected with the connections of the shifting cylinder and/or the lifting cylinder, respectively, makes operation possible at a safe distance from the load. The use of a slide plate between the lifting cylinder and the base for the lifting cylinder makes possible the balancing of traverse forces occurring during shifting and thereby preventing dangerous instabilities of the load that is to be shifted.

It is particularly advantageous of the shifting device in a position, in contrast to the previously known shifting devices, to make possible a bilateral shifting of the load without additional measures to be taken from below the load. The shifting device 1 represents a very considerable technical contribution in the respective field of the rerailing technology.

Various changes in practice and modifications in structure may evidently be introduced in the foregoing particularly disclosed and described embodiments and practices without departing from the invention. Thus, such embodiments and practices are intended in an illustrative and not in a limiting sense. The true spirit and scope of the invention is set forth in the ensuing claims.

What is claimed is:

1. A shifting device for horizontal shifting of heavy loads with at least one lifting cylinder to raise the load, a support, and a hydraulically actuated shifting mechanism, wherein the shifting mechanism has at least one horizontally arranged shifting cylinder which by means of a locking tie-rod is mechanically lockable to the support in different positions on the surface of the support, and which engages the lifting cylinder and effects a horizontal shifting of the lifting cylinder relative to the support, characterized in that in a tie-rod casing, the locking tie-rod can be brought vertically from a rest position to a locking position and vice versa, that the locking in the locking position is effective in both directions to the support, and that the shifting cylinder can be acted on by force in both directions.

2. A shifting device according to claim 1, wherein the locking tie-rod is initially tensioned in the locking position by means of a spring.

3. A shifting device according to claim 2, wherein the locking tie-rod being brought from the locking position to the unlocking position is effected hydraulically.

4. A shifting device according to claim 1, wherein the tie-rod casing has guide plates which engage the support and hold the locking tie-rod in a predetermined position at right angles to the longitudinal axis of the support.

5. A shifting device according to claim 4, wherein the support has recesses along its longitudinal extension, into which the locking tie-rod dips in the respective locking position of the shifting cylinder.

6. A shifting device according to claim 5, wherein the recesses are dimensioned in such a way that during the shifting movement along the support, the locking tie-rod falls spontaneously into the respective recess or moves automatically into the recess in accordance with the initial tension of the locking tie-rod.

7. A shifting device according to claim 1, wherein said shifting device includes a visual controlling device for indicating the respective operating status of the locking position or the unlocking position of the locking tie-rod.

8. A shifting device according to claim 7, wherein the tie-rod casing is fashioned in such a manner that in the unlocking state a tie-rod head protrudes from an upper side of the tie-rod casing.

9. A shifting device according to claim 7, wherein the tie-rod casing includes a spring-loaded control pin provided at the upper side of the tie-rod casing, which protrudes from the upper side of the tie-rod casing counter to the spring tension when the locking tie-rod is unlocked.

10. A shifting device according to claim 7, wherein on a side of the locking tie-rod that is dipping into a respective recess, the locking tie-rod has an upward tapering shape at least over a part of peripheral area of the locking tie-rod.

11. A shifting device according to claim 1, wherein the shifting cylinder is a double-acting shifting cylinder.

12. A shifting device according to claim 11, wherein the shifting cylinder is a telescopic shifting cylinder.

13. A shifting device according to claim 1, wherein the lifting cylinder and the base of the lifting cylinder have a slide plate provided therebetween.

14. A shifting device according to claim 13, wherein the slide plate is connected by way of a holding boss on a bottom side of the slide plate to the base for the lifting cylinder, wherein the holding boss engages a corresponding recess in the base for the lifting cylinder and a lateral movement of the slide plate is provided relative to a moving direction Of the base for the lifting cylinder.

15. A shifting device according to claim 14, wherein the lateral movement of the slide plate is provided in a cross direction to the moving direction of the base for the lifting cylinder.

16. A shifting device according to claim 1, wherein the shifting device is connected to a control platform by way of hydraulic leads connected with connections on the shifting cylinder and on the lifting cylinder.

17. A shifting device according to claim 1, wherein the locking tie-rod being brought from the locking position to the unlocking position is effected hydraulically.

* * * * *